US005564529A

United States Patent [19]

Ericson et al.

[11] Patent Number: 5,564,529

[45] Date of Patent: Oct. 15, 1996

[54] ELEVATOR CAR FRAME AND PLATFORM ASSEMBLY

[75] Inventors: Richard J. Ericson, Southington, Conn.; T. Thomas Suchodolski, Ware, Mass.; Minglun Qiu, Bloomington, Ind.

[73] Assignee: Otis Elevator Company, Farmington, Conn.

[21] Appl. No.: 346,127

[22] Filed: Nov. 29, 1994

[51] Int. Cl.[6] ..... B66B 11/02

[52] U.S. Cl. ..... 187/401

[58] Field of Search ..... 187/401, 313

[56] References Cited

U.S. PATENT DOCUMENTS

| | | | |
|---|---|---|---|
| 4,848,519 | 7/1989 | Ericson et al. | 187/1 R |
| 5,306,879 | 4/1994 | Pearson | 187/401 X |

FOREIGN PATENT DOCUMENTS

| | | | |
|---|---|---|---|
| 566424 | 10/1993 | European Pat. Off. | 187/401 X |
| 1136467 | 9/1962 | Germany | 187/401 X |
| 295694 | 4/1990 | Japan | 187/401 X |
| 416484 | 1/1992 | Japan | 187/401 X |
| 5132269 | 5/1993 | Japan | 187/401 X |
| 5246658 | 9/1993 | Japan | 187/401 X |

*Primary Examiner*—H. Grant Skaggs
*Assistant Examiner*—Dean A. Reichard

[57] ABSTRACT

An elevator car includes a car frame and a platform assembly having a composite platform and a support frame. The composite platform includes upper and lower metallic sheets with a oriented strand wood layer therebetween and bonded to the sheets. The support frame includes a perimeter structure and a pair of centrally located stringers. The composite platform is rigidly attached about its outer edges to the perimeter structure and extends unsupported between the centrally located stringers and the perimeter structure. In a particular embodiment, the elevator car includes a door frame extending from the car frame and platform assembly and which is isolated from the cab of the elevator car.

28 Claims, 3 Drawing Sheets

ELEVATOR CAR FRAME AND PLATFORM ASSEMBLY

TECHNICAL FIELD

The present invention relates to elevators, and more specifically to car frames and platform assemblies for elevators.

BACKGROUND OF THE INVENTION

A traditional platform for an elevator car is comprised of a steel plate or sheet over a plurality of steel stringers. The steel plate provides a smooth surface for the floor and the steel stringers provide a rigid structure. Although such a configuration is sufficient for most purposes, it suffers from the drawback of being very heavy and expensive to fabricate.

Of more recent development are honeycomb platforms. These are typically a honeycomb core material sandwiched between two thin sheets of metal and a top layer of some form of structural material. The additional top layer of material is necessary to provide structure to anchor cab components to, such as a car door threshold. The honeycomb layer alone, unfortunately, tends to buckle under the compressive forces of a typical through-bolt fastener for the threshold or other component. Another drawback to this type of platform is the thickness of the honeycomb layer required to carry the operational loads. A thick platform necessitates a larger car frame.

Another recent development is the use of wood composite platforms. An example of this type of platform is disclosed in U.S. Pat. No. 4,848,519, entitled "Structural Support for Hydraulic Elevator Car" and issued to Ericson et al. The platform disclosed therein is comprised of a floor portion formed from wood, composite or oriented strand wood fiber material and a metallic lower plate functioning as a fire stop. The support frame for the platform includes a planar array of tubular beams disposed widthwise relative to the elevator. This configuration reduces the weight of the platform as compared to traditional types of platforms.

In addition to weight, a further consideration is the noise level within the elevator cab. The elevator cab is subjected to numerous sources of vibration and acoustic energy, such as the operation of the doors. The doors are typically hung from a door frame attached to the cab and actuated by a motor unit disposed on the elevator car. Operation of the doors produces vibration energy that may be transmitted into the cab and which is disturbing to the passengers within the cab. The conventional solution to this is to sound isolate the doors from the cab by providing a sound isolation frame under the platform assembly and extending the door frame from the sound isolation frame and the car frame. In effect, the doors and door frame are separate from the cab. Sound isolation pads are placed between the sound isolation frame and the platform assembly and between the car frame and the platform assembly. The additional sound isolation frame, however, adds to the weight and cost of the elevator.

The above art notwithstanding, engineers and scientists under the direction of Applicant's assignee are working to develop lightweight, durable elevator car frames and platform assemblies that result in a quiet and comfortable ride for the elevator passengers.

SUMMARY OF THE INVENTION

The present invention is predicated in part upon the recognition that the configuration of the support frame for prior art platforms led to creep of the platforms. Creep is defined as the permanent deformation that occurs over time in a structure under a load. In elevator car platforms, elastic/plastic flow of the adhesive bonding the layers together or plastic flow of the honeycomb core layer may occur. Creep of the platform may result in the platform deforming to the extent whereby the floor of the elevator droops and, as a result, is offset from the floor of the elevator landing. Such a situation is disturbing to the passengers of the elevator and may lead to premature replacement of the platform. In a typical platform assembly, the stringers are positioned such that a front and back portion of the platform is cantilevered. As a result of the constant, dead weight loading of these cantilevered portions of the platform by the doors and walls of the elevator car, the platform permanently deforms. Permanent deformation in these regions produces a mismatch between the floor of the car and the landing.

According to the present invention, a composite platform for an elevator car includes an upper and lower sheet and a structural core layer disposed between and bonded to the upper and lower sheets. In a particular embodiment of the composite platform, the upper and lower sheets are formed from a metallic material and the core layer is formed from an oriented strand wood.

The composite platform is thin and lightweight, yet strong enough to carry the loads encountered during use. The core layer of the composite platform provides strength to support the operational loads over the spans of the platform. The upper and lower sheets carry the compression and tension loads in the upper and lower surfaces, respectively, of the platform. In addition, the upper sheet provides a smooth, flat surface upon which the flooring of the elevator car may be installed.

According to another specific embodiment of the present invention, a platform assembly for an elevator car includes a composite platform and a support frame having a perimeter structure extending about the outer edges of the platform and a pair of centrally located stringers. The composite platform is formed from upper and lower metallic sheets with a structural core layer disposed between and bonded to the metallic sheets. The platform is rigidly attached to the perimeter structure and extends unsupported between the stringers and the perimeter structure.

A principle feature of this specific embodiment is the perimeter support of the composite platform. This type of support eliminates the cantilevered sections of the platform and thereby reduces the amount of permanent deformation or creep of the platform during use. As a result, the present invention improves the durability of the platform relative to prior art configurations. In addition, the combination of the composite platform and the support frame results in a lightweight platform assembly that is less costly to manufacture than traditional platform assemblies.

According to a further specific embodiment, an elevator car includes a car frame, a platform assembly, and a door frame extending between and supported by the platform assembly and car frame. The car frame includes a plank beam, a pair of posts extending vertically from the plank beam, and a pair of braces extending from each of the posts and connected to the platform assembly. The platform assembly includes a support frame having a perimeter structure and a pair of centrally located stringers and a composite platform having an upper metallic sheet, a lower metallic sheet, and a structural core layer formed from an oriented strand wood. The door frame includes a pair of horizontal supports extending from the posts, an overhead support extending between the horizontal supports, and a pair of vertical supports extending upward from the platform assembly. A plurality of sound isolation pads are disposed between the platform assembly and the plank beam, the braces, and the vertical supports for the door.

A principle feature of this further specific embodiment is the mounting of the door frame, and indirectly the doors supported by the door frame, directly to the platform assembly. Another feature is the sound isolation pads disposed between the door frame and the platform assembly and between the braces and the platform assembly. The advantage resulting from this configuration is the weight and cost savings associated with the elimination of a separate sound isolation frame. The location of the plurality of sound isolation pads isolates the platform assembly and the cab from the car frame and the door frame and provides a quiet and comfortable ride for the passengers of the elevator.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
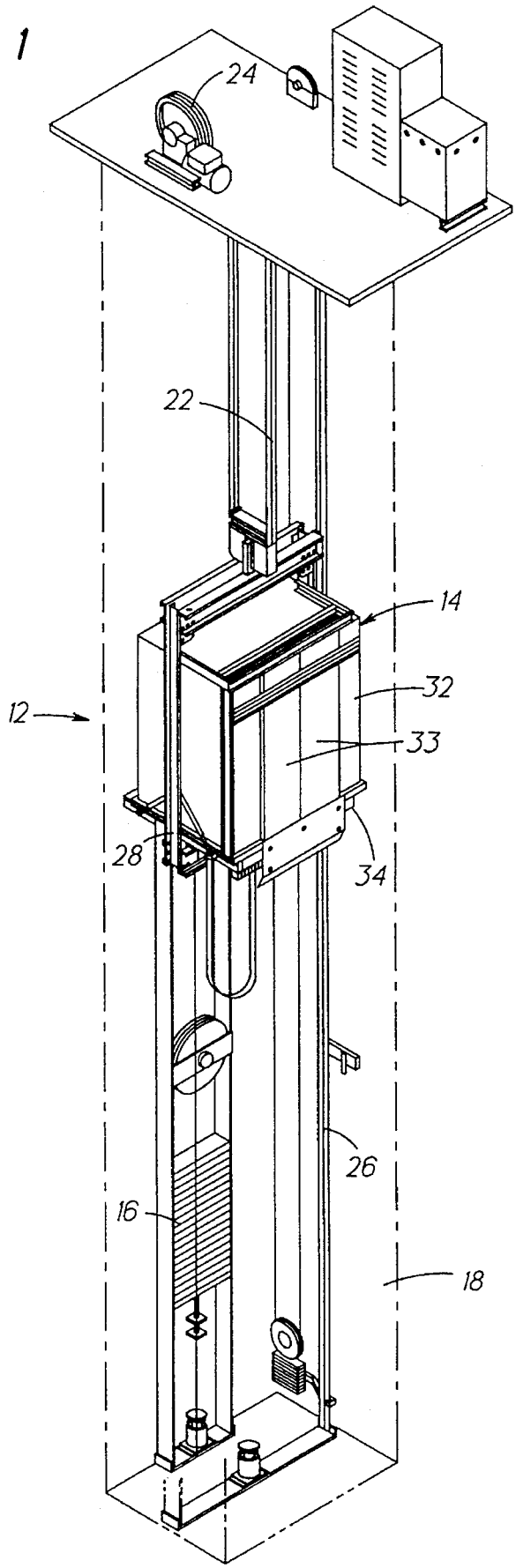
FIG. 1 is a perspective view of an elevator hoistway and an elevator.

An elevator 12 is illustrated in FIG. 1. The elevator 12 includes a car 14 and a counterweight 16 suspended within a hoistway 18 by a rope 22 extending over a sheave 24. As is well known, the car 14 and counterweight 16 ride on guide rails 26 and move in opposite directions within the hoistway 18.

The car 14 includes a car frame 28, a cab 32 having a pair of doors 33, and a platform assembly 34. The car frame 28 is engaged with the guide rails 26 and rope 22 and supports the load of the cab 32, platform assembly 34 and passengers or freight (not shown) within the cab 32. The cab 32 sits on the platform assembly 34.

Figure 2:
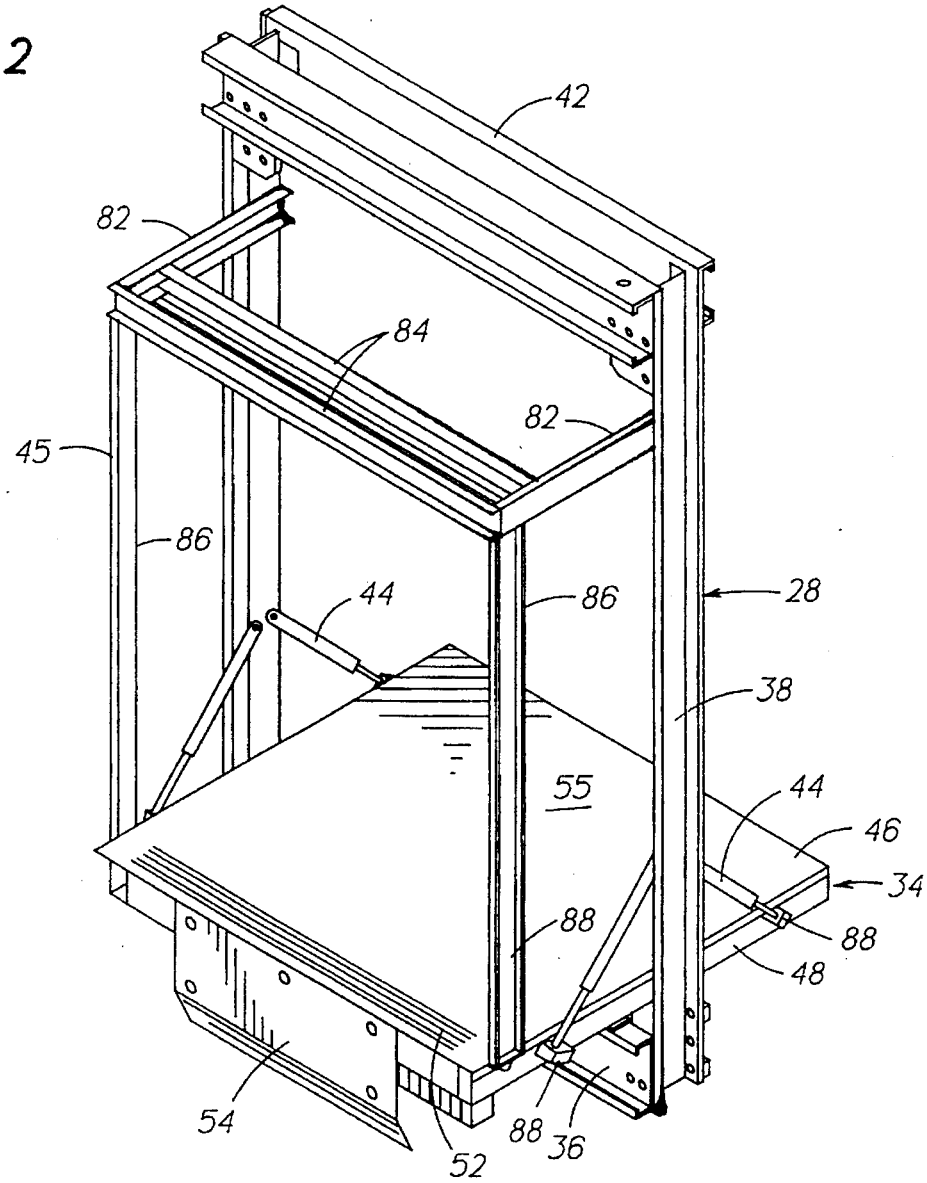
FIG. 2 is a perspective view of the car frame and platform assembly with the cab removed.

Referring now to FIG. 2, the car frame 28 and platform assembly 34 is shown with the cab 32 removed. The car frame 28 includes a plank beam 36, a pair of posts 38 extending vertically from the plank beam 36, a crosshead 42 connecting the tops of the posts 38, two pair of braces 44, and a door frame 45. The crosshead 42 is attached to the rope 22. The door frame 45 supports the doors 33 of the cab 32.

Figure 3:
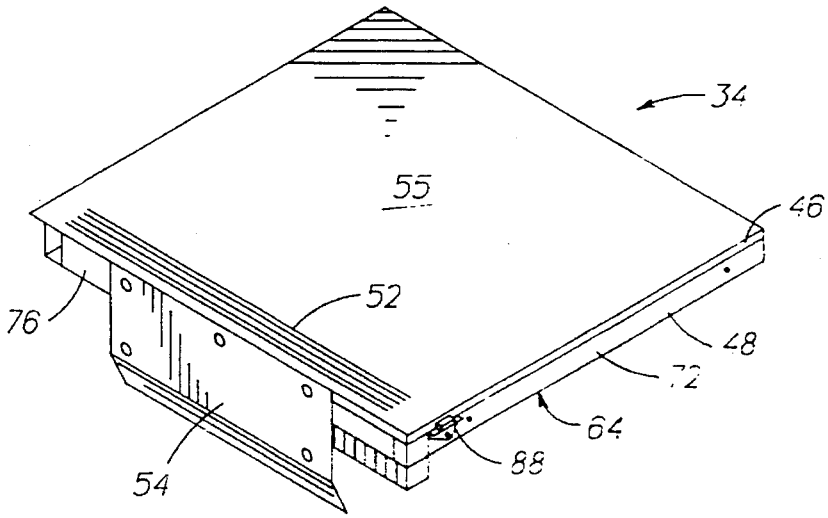
FIG. 3 is a top view of the platform assembly.
Figure 4:
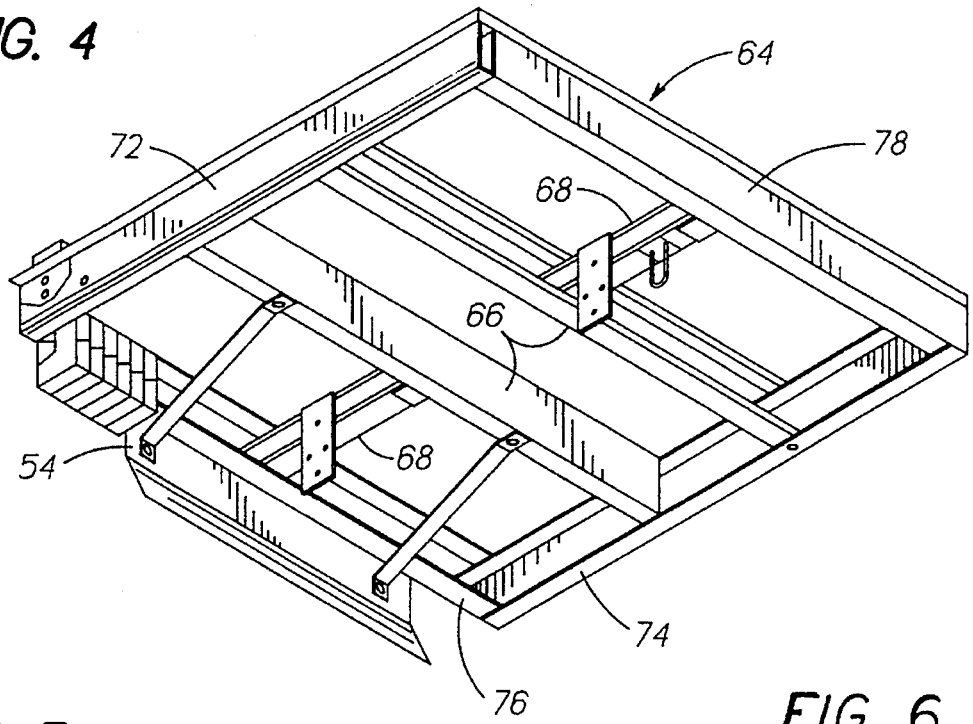
FIG. 4 is a bottom view of the platform assembly.
Figure 5:
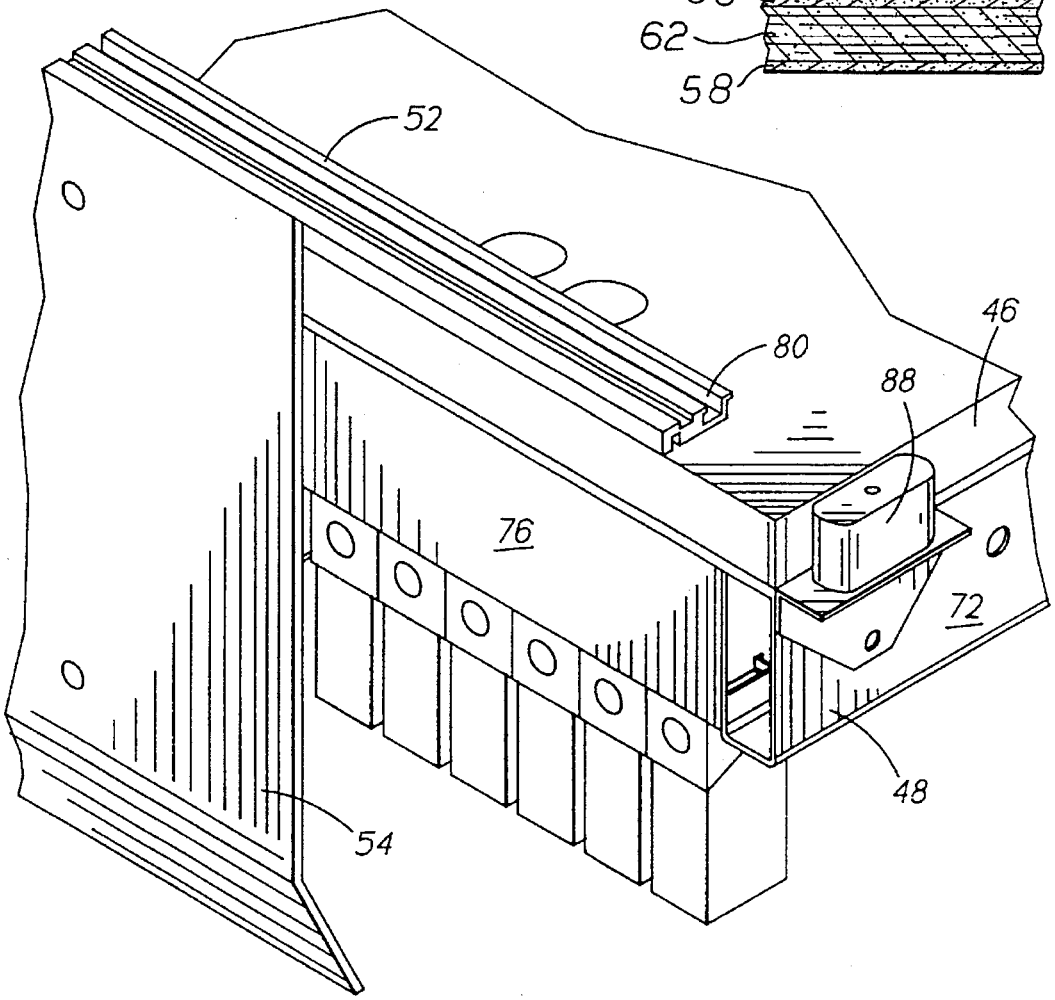
FIG. 5 is a perspective view of a front corner of the platform assembly.

The platform assembly 34, shown in more detail in FIGS. 3 and 4, includes a platform 46, a support frame 48, a door threshold 52, and a toe guard 54. The platform assembly 34 is supported by the plank beam 36 and is stabilized by the pair of braces 44 on either side of the platform assembly 34.

Figure 6:
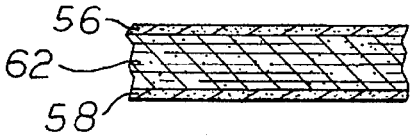
FIG. 6 is a cross-sectional view of the platform.

The platform 46 extends widthwise and depthwise to define the top surface 55 of the platform assembly 34 and the floor of the cab 32. The platform 46 includes an upper sheet 56, a lower sheet 58, and structural core layer 62 sandwiched therebetween, as shown in FIG. 6. The sheets 56,58 and the layer 62 are bonded together using an adhesive. The upper and lower sheets 56,58 are metallic and provide sufficient strength to withstand the compression and tensile forces present in the top and bottom, respectively, of the platform 46 under operational loads. In addition, the metallic upper sheet 56 provides a smooth, flat surface for the floor of the cab 32. The structural core layer 62 is formed from a high strength, oriented strand wood product. The orientation of the core layer 62 is such that the strands extend from front to back to provide maximum strength over the largest extensions of the platform 46, as will be discussed infra.

It is suggested to use aluminum for the upper and lower sheets 56,58, although other metal may perform sufficiently well. Aluminum is suggested because of its light weight, the low manufacturing cost associated with it, and for its corrosion resistance. The corrosion resistant characteristic is especially significant for elevator installations near sources of salt water, e.g. a building near an ocean beach. For the structural core layer 62, it is suggested that an oriented strand wood product be used, such as TIMBER STRAND LSL available commercially from Truss Joist MacMillan located in Plymouth, Minn. A suggested adhesive for bonding the sheets 56,58 and the structural core layer 62 together is a water based, high performance contact adhesive XR 1377 available from H-B Fuller located in St. Paul, Minn.

The support frame 48 extends under and around the perimeter of the platform 46. As shown in FIG. 4, the support frame 48 includes a perimeter structure 64, a pair of stringers 66, and cross supports 68. The perimeter structure 64 includes a first side beam 72, a second side beam 74, a front beam 76 and a back beam 78. The pair of stringers 66 are centrally located (front to back). The cross supports 68 provide means to attach traveling cables and/or compensating chains to the car 14.

The platform 46 is rigidly attached to both the perimeter structure 64 and the stringers 66 by fastening at a plurality of points around the outer edges of the platform 46 and across the center of the platform 46 above the stringers 66. The platform 46 extends unsupported between the stringers 66 and the front and back beams 76,78. This unsupported extension is possible due to the strength of the platform 46 and the rigid fastening of the outer edges of the platform 46 to all four beams 72,74,76,78 of the perimeter structure 64. As a result of this fastening, the combined platform 46 and support frame 48 cooperate to produce a thin, lightweight but very rigid structure.

In addition, having the perimeter structure 64 of the support frame 48 extend about the outer edges of the platform 46 eliminates cantilevered portions of the platform 46. The outer edges of the platform 46 are continuously loaded by the walls and doors of the cab 32. Under this continuous loading, the cantilevered portions of prior art platforms, i.e. the outer edges and particularly the front and back edges, tend to creep over time. This creep results in the floor of the cab drooping and not matching the level of the floor of the elevator landing. The platform and support frame according to the present invention do not have the cantilevered portions and therefore eliminate this source of creep deformation.

The door threshold 52 and the door frame 45 define means to support and guide the doors 33 of the cab 32. The threshold 52 includes a slot 80 that engages the doors 33 to guide them during opening and closing. The threshold 52 is fastened directly to the platform 46 by a plurality of fasteners, such as through bolts or wood screws, extending through or into the platform 46. Being able to fasten the threshold 52 directly to the platform 46 eliminates the need for an additional layer of structural material to secure the fasteners, as is required for honeycomb platforms.

Referring back to FIG. 2, the door frame 45 supports the doors 33 and provides guidance for the upper portion of the door that is in register with the slot 80 of the threshold 52. The door frame 45 includes a pair of horizontal supports 82 extending outward from the posts 38, a pair of overhead supports 84 extending between the outward ends of the horizontal supports 82, and a pair of vertical supports 86 extending between the platform assembly 34 and the outward ends of the horizontal supports 82. The doors 33 and actuation means for the door (not shown) is supported from the overhead supports 84. Sound isolation pads 88 are disposed between the vertical supports 86 and the platform assembly 34, between the braces 44 and the platform assembly 34, and between the plank beam 36 and the platform assembly 34. The isolation pads 88 attenuate vibration transmission into the platform assembly 34. As a result, the car frame 28 and door frame 45 is isolated from the platform assembly 34 and the cab 32. Isolating the door frame 45 from the cab 32 permits the doors 33, and the associated door operating mechanisms, to be isolated from the cab 32, thereby reducing the noise and vibration within the cab 32 during operation of the doors 33.

Although the invention has been shown and described with respect to exemplary embodiments thereof, it should be understood by those skilled in the art that various changes, omissions, and additions may be made thereto, without departing from the spirit and scope of the invention.

What is claimed is:

1. A platform assembly for an elevator car, the platform assembly including:

a platform; and a support frame having a perimeter structure extending about the outer edges of the platform, the support frame including a centrally located stringer extending across the support frame such that the platform extends unsupported between the stringer and the perimeter structure.

2. The platform assembly according to claim 1, wherein the platform is a composite platform and includes:

an upper sheet providing support of compression loads;

a lower sheet providing support of tensile loads; and a structural core layer formed from a composite material, the core layer being disposed between and bonded to the upper and lower sheets.

3. The platform according to claim 2, wherein the core layer is formed from an oriented strand wood.

4. The platform assembly according to claim 1, wherein the platform is rigidly attached to the perimeter structure and stringer.

5. The platform assembly according to claim 4, wherein the platform is a composite platform and includes:

an upper sheet providing support of compression loads;

a lower sheet providing support of tensile loads; and a structural core layer formed from a composite material, the core layer being disposed between and bonded to the upper and lower sheets.

6. The platform according to claim 5, wherein the core layer is formed from an oriented strand wood.

7. An elevator car including:

a car frame having a plank beam extending horizontally a pair of posts extending vertically from the plank beam, each one of the pair being on opposite sides of the plank beam, and a pair of braces extending from each of the posts;

a platform assembly disposed on the plank beam between the posts, the platform assembly supported by the plank beam and connected to the posts via the pair of braces to stabilize the platform assembly, the platform assembly including:

a support frame; and a composite platform, the composite platform including:

an upper sheet providing support of compression loads;

a lower sheet providing support of tensile loads; and a structural core layer formed from a composite material, the core layer being disposed between and bonded to the upper and lower sheets; and a cab having a door and a door frame for supporting and guiding the door, the door frame including a pair of horizontal supports extending from the car frame and each support having an outward end, an overhead support extending between the outward ends of the horizontal supports and providing means to support the door and an actuating means for the door, and a pair of vertical supports extending upward from the platform assembly.

8. The elevator car according to claim 7, further including a plurality of sound isolation means including a first sound isolation means disposed between the car frame and the platform assembly, a second sound isolation means disposed between the door frame and the platform assembly, whereby the platform assembly and the cab are isolated from the vibration energy of the doors.

9. An elevator car including:

a car frame having a plank beam extending horizontally, a pair of posts extending vertically from the plank beam, each one of the pair being on opposite sides of the plank beam, and a pair of braces extending from each of the posts; and a platform assembly disposed on the plank beam between the posts, the platform assembly supported by the plank beam and connected to the posts via the pair of braces to stabilize the platform assembly, the platform assembly including:

a platform; and a support frame having a perimeter structure extending about the outer edges of the platform, the support frame including a centrally located stringer extending across the support frame, such that the platform extends unsupported between the stringer and the perimeter structure.

10. The elevator car according to claim 9, wherein the platform is rigidly attached to the perimeter structure and stringer.

11. The elevator car according to claim 9, wherein the platform is a composite platform and includes:

an upper sheet providing support of compression loads;

a lower sheet providing support of tensile loads; and a structural core layer formed from a composite material, the core layer being disposed between and bonded to the upper and lower sheets.

12. The platform according to claim 11, wherein the core layer is formed from an oriented strand wood.

13. The elevator car according to claim 9, further including a cab having a door and a door frame for supporting and guiding the door, the door frame including a pair of horizontal supports extending from the car frame and each support having an outward end, an overhead support extending between the outward ends of the horizontal supports and providing means to support the door and an actuating means for the door, and a pair of vertical supports extending upward from the platform assembly.

14. The elevator car according to claim 13, further including a plurality of sound isolation means including a first sound isolation means disposed between the car frame and the platform assembly, a second sound isolation means disposed between the door frame and the platform assembly, whereby the platform assembly and the cab are isolated from the vibration energy of the doors.

15. The elevator car according to claim 11, further including a cab having a door and a door frame for supporting and guiding the door, the door frame including a pair of horizontal supports extending from the car frame and each support having an outward end, an overhead support extending between the outward ends of the horizontal supports and providing means to support the door and an actuating means for the door, and a pair of vertical supports extending upward from the platform assembly.

16. The elevator car according to claim 15, further including a plurality of sound isolation means including a first sound isolation means disposed between the car frame and the platform assembly, a second sound isolation means disposed between the door frame and the platform assembly, whereby the platform assembly and the cab are isolated from the vibration energy of the doors.

17. The elevator car according to claim 10, wherein the platform is a composite platform and includes:

an upper sheet providing support of compression loads;

a lower sheet providing support of tensile loads; and a structural core layer formed from a composite material, the core layer being disposed between and bonded to the upper and lower sheets.

18. The platform according to claim 17, wherein the core layer is formed from an oriented strand wood.

19. The elevator car according to claim 10, further including a cab having a door and a door frame for supporting and guiding the door, the door frame including a pair of horizontal supports extending from the car frame and each support having an outward end, an overhead support extending between the outward ends of the horizontal supports and providing means to support the door and an actuating means for the door, and a pair of vertical supports extending upward from the platform assembly.

20. The elevator car according to claim 19, further including a plurality of sound isolation means including a first sound isolation means disposed between the car frame and the platform assembly, a second sound isolation means disposed between the door frame and the platform assembly, whereby the platform assembly and the cab are isolated from the vibration energy of the doors.

21. The elevator car according to claim 17, further including a cab having a door and a door frame for supporting and guiding the door, the door frame including a pair of horizontal supports extending from the car frame and each support having an outward end, an overhead support extending between the outward ends of the horizontal supports and providing means to support the door and an actuating means for the door, and a pair of vertical supports extending upward from the platform assembly.

22. The elevator car according to claim 21, further including a plurality of sound isolation means including a first sound isolation means disposed between the car frame and the platform assembly, a second sound isolation means disposed between the door frame and the platform assembly, whereby the platform assembly and the cab are isolated from the vibration energy of the doors.

23. An elevator car including:

a car frame having a plank beam extending horizontally, a pair of posts extending vertically from the plank beam, each one of the pair being on opposite sides of the plank beam, and a pair of braces extending from each of the posts;

a platform assembly disposed on the plank beam between the posts, the platform assembly supported by the plank beam and connected to the posts via the pair of braces to stabilize the platform assembly;

a cab having a door; and a door frame for supporting and guiding the door, the door frame including a pair of horizontal supports extending from the car frame and each support having an outward end, an overhead support extending between the outward ends of the horizontal supports and providing means to support the door and an actuating means for the door, and a pair of vertical supports extending upward from the platform assembly.

24. The elevator car according to claim 23, further including a plurality of sound isolation means including a first sound isolation means disposed between the car frame and the platform assembly, a second sound isolation means disposed between the door frame and the platform assembly, whereby the platform assembly and the cab are isolated from the vibration energy of the doors.

25. The elevator car according to claim 23, wherein the platform is a composite platform and includes:

an upper sheet providing support of compression loads;

a lower sheet providing support of tensile loads; and a structural core layer formed from a composite material, the core layer being disposed between and bonded to the upper and lower sheets.

26. The platform according to claim 25, wherein the core layer is formed from an oriented strand wood.

27. The elevator car according to claim 24, wherein the platform is a composite platform and includes:

an upper sheet providing support of compression loads;

a lower sheet providing support of tensile loads; and a structural core layer formed from a composite material, the core layer being disposed between and bonded to the upper and lower sheets.

28. The platform according to claim 27, wherein the core layer is formed from an oriented strand wood.

* * * * *